United States Patent [19]

Bercovici

[11] Patent Number: 4,497,360

[45] Date of Patent: Feb. 5, 1985

[54] METHOD OF MONITORING AND CONTROLLING OPERATING PARAMETERS OF A MACHINE FOR THE CONTINUOUS CASTING OF STRIPS BETWEEN ROLLS

[75] Inventor: Serge Bercovici, Grenoble, France

[73] Assignee: Cegedur Societe de Transformation de l'Aluminiu, Pechiney, Paris, France

[21] Appl. No.: 295,532

[22] Filed: Aug. 24, 1981

[30] Foreign Application Priority Data

Sep. 1, 1980 [FR] France ..... 80 19162

[51] Int. Cl.[3] ..... B22D 11/16

[52] U.S. Cl. ..... 164/454; 164/413

[58] Field of Search ..... 164/413, 451, 452, 453, 164/454

[56] References Cited

U.S. PATENT DOCUMENTS 3,478,808 11/1969 Adams ..... 164/454

*Primary Examiner*—Kuang Y. Lin
*Assistant Examiner*—Richard K. Seidel
*Attorney, Agent, or Firm*—McDougall, Hersh & Scott

[57] ABSTRACT

The invention relates to a method for the monitoring and control of operating parameters of a machine for the continuous casting of strips between rolls, including the torque exerted on at least one of the rolls to cause the strip to advance and/or the stress exerted by the strip on at least one of the journals and/or the temperature of the strip as it leaves the rolls and permanently measuring the deviation between the instantaneous value of one of these parameters and the mean value of this parameter over a period of time immediately beforehand. If this deviation exceeds a reference deviation, the casting speed of the machine is reduced until the deviation again becomes less than the reference deviation. The speed of the casting machine is then increased for as long as this deviation remains lower than the reference deviation.

11 Claims, 1 Drawing Figure

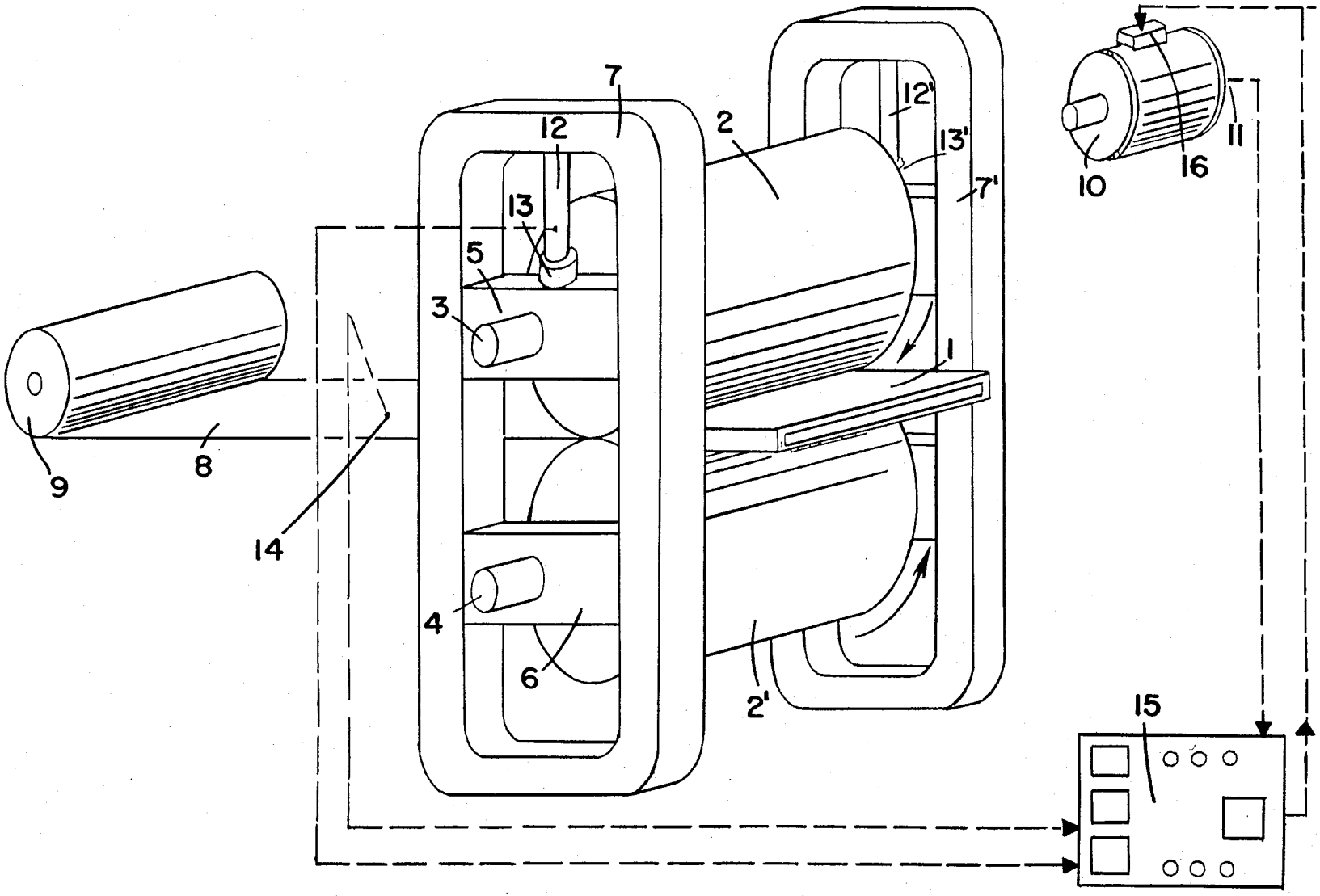
1
2
2'
3
4
5
6
7
7'
8
9
10
11
12
12'
13
13'
14
15
16

METHOD OF MONITORING AND CONTROLLING OPERATING PARAMETERS OF A MACHINE FOR THE CONTINUOUS CASTING OF STRIPS BETWEEN ROLLS

INTRODUCTION

The present invention relates to a method for the monitoring and control of operating parameters of a machine for the casting of strips between rolls intended to optimize the conditions for obtaining a product of high quality and, in particular, for increasing productivity.

BACKGROUND OF THE INVENTION

The skilled man knows of casting machines with a moving mold with rolls which are used for manufacturing, directly from a mass of molten metal, a continuous strip having a width which can be as large as several meters and a thickness of approximately one centimeter.

These machines are constituted principally:

(a) on the one hand by a liquid metal supply device comprising, in succession in the direction of flow of the metal:

(i) a furnace for keeping the metal in the liquid state, (ii) a runner for circulation equipped with a system adjusting the level and the rate of flow of the metal, (iii) a nozzle for the distribution of the metal having at its outlet end an opening of rectangular cross-section;

(b) on the other hand, a cooling and rolling device comprising two rolls of which the axles are parallel and spaced more or less from each other depending on the desired strip thickness. These rolls are provided at each of their ends with axial or journalled cylindrical extensions which engage via bearings in openings made in supporting or chock cross beams equipped with a gripping system and integral with two vertical columns forming the frame of the machine. These rolls are provided internally with a network of channels along which a coolant circulates and communicate with a motor which sets them into rotation in opposite directions.

These two devices are placed in relation to each other in such a way that the outlet cross-section of the nozzle is parallel to the axles of the rolls and is situated at a certain distance from the plane passing through these axles which is called the outlet plane.

During operation of the machine, the metal distributed by the nozzle fills the free space between the rolls along an arc of a circle contained between the plane of the outlet cross-section of the nozzle and the outlet plane of the cylinders.

Due to the action of the rolls, the metal cools, begins to solidify at a point known as the marsh or partly solidified metal, owing to the presence of a more or less viscous mixture of crystals and liquid situated at a distance from the plane of the outlet cross-section of the nozzle, generally known as the depth of partly solidified metal. The metal then solidifies completely and is driven towards the outlet plane of the rolls in a progressively restricted space where it is subjected to a rolling stress which gradually brings it to the desired thickness at the moment when it exits through the space between the rolls in the form of a strip which is then taken up by a roller.

This strip is then subjected to various mechanical and/or thermal treatments which lead to products such as thin sheet, for example, of which the mechanical properties: strength, yield stress, elongation, hardness, etc., are, in part, a function of the quality of the strip issuing from the casting machine.

It is, therefore, important to attempt to maintain a high quality from the beginning to the end of the casting of the strip. For this purpose, the machine must be made to operate under the conditions most favorable for obtaining such a result, even if it is used at its maximum speed.

A high quality necessitates the absence of defects such as cracks, fissures or break-out of metal as it leaves the rolls. Now several causes for the appearance of defects in strips manufactured from the casting machines under consideration are known. These are generally variations in certain operating factors such as as the temperature of the metal supplying the machine, the rate of flow of the coolant from the rolls, the state of the surface of the rolls connected with the conditions of lubrication, the composition of the cast metal, the level of the metal in the runner, etc.

Any variation of one of these factors can, depending on its magnitude, disturb the operation of the machine, that is to say produce an instability in the partly solidified metal at certain points of the strip which can reach the outlet plane of the rolls. This local instability of the partly solidified metal causes the appearance of greater or smaller defects on the strip, sometimes necessitating the rejection thereof.

The causes of defects are also connected to the speed of casting. In fact, it has been observed that beyond certain speeds, the stability of operation of the machine becomes more critical and more sensitive to certain hazards and, in particular, to variations in the operating factors listed above, which are translated by the increased frequency in the appearance of defects.

With regard to the causes of defects, a distinction should be made between those due to factors of which a variation can easily be detected such as the temperature, the level of metal, the flow rate of water. In these cases, it is easy to carry out automatic monitoring with an alarm permitting the operator of the machine to ready this variation rapidly. However, when dealing with factors such as the composition of the metal case or the surface state of the rolls, it seems to be fairly difficult, if not impossible, to be able to detect continuously the variation thereof. The operator can therefore react only on appearance of the defect, which causes a part of the strip to be rejected.

Whether the variation is detectable or not, it demands the permanent availability of the operator. However, owing to external constraints, the manufacturing staff cannot always react instantaneously or have their eye fixed on the strip, and a large defect such as a break-out sometimes appears and then necessitates a stoppage of the machine. This is why casting machines are frequently used at speeds far below their capacity so as to avoid the appearance of these defects due to possible variations in the operating factors.

SUMMARY OF THE INVENTION

In order to overcome these disadvantages, the applicants have examined and developed a process for monitoring and controlling operating parameters of the casting machine intended to optimize the conditions for obtaining a product of high quality and, in particular, to increase productivity.

This process is characterized in that at least one of the parameters from the group constituted by the torque exerted on at least one of the rolls to cause the strip to advance, the stress exerted by the strip on at least one of the journals, the temperature of the strip as it leaves the rolls is considered, the deviation between the instantaneous value of the considered parameter and the mean value of this same parameter is measured over a period of time immediately beforehand. If this deviation becomes negative with regard to the torque and stress and positive with regard to the temperature and higher in absolute value than a reference deviation, the speed of casting is reduced until the deviation becomes lower than the reference deviation and the casting speed is then increased while the deviation between the instantaneous value of the parameter and the mean value of this parameter over a period of time immediately beforehand does not exceed the reference deviation.

The process according to the invention therefore consists firstly in considering only a few operating parameters such as the torque exerted on at least one of the rolls to cause the strip to advance, the stress exerted by the strip on at least one of the journals of each roll, and the temperature of the strip on leaving the rolls. The monitoring and control can be carried out on one or two or three parameters at the same time.

The use of these parameters instead of the operating factors listed above is due to the fact that these parameters have been found to integrate in some way the fluctuations of these various factors as well as other measurable factors and that their value therefore varied as a function of these factors. Thus, if these factors vary in such a way that the partly solidified metal becomes locally unstable, the torque and the stress diminish continuously in the course of time whereas, on the other hand, the temperature increases. An original method of detecting defects has thus been found. For this purpose, it is sufficient to measure the value of these parameters and to follow the development thereof.

The methods of measurement are classical. With regard to the torque, it is possible to use, for example, the intensity of the electrical current supplying the motor for controlling the rotation of the rolls or to use the readings of a strain gauge placed on one of the journals; with regard to the stress exerted by the strip, a deformation gauge can be placed, for example, between the chocks of the rolls and the gripping screws of the hydraulic pressure of the gripping circuit can be measured; with regard to the temperature, it is possible to take, for example, a thermo-electric probe or an optical pyrometer mounted so as to be able to scan the entire width of the strip and to determine a mean temperature value.

However, the invention can be carried out with the aid of any measurement means whatever.

The measurements taken in this way are transmitted to a calculator of the computer, mini-computer, micro processor or programmable automaton type capable of calculating mean values. In fact, the invention is characterized in that the deviation is measured between the instantaneous value of the parameter and the mean value of this same parameter over a period of time immediately beforehand. The apparatus receiving the information on the values of the parameters must therefore be capable of remembering them over a given period of time $\Delta t$ and of calculating the mean value. At this moment, it must also be capable of measuring the deviation between the value of the parameter at moment t and the mean value of this same parameter over the period $\Delta t$ which has just passed, and then of comparing it to a reference deviation and, depending on the value of this deviation, of emitting or not emitting a signal intended to modify the speed of casting by the machine.

Not every deviation will be taken into consideration by the calculator. In fact, it has been found, with regard to the torque and the stress, that the fluctuations likely to cause the appearance of defects such as fissures, cracks, break-outs, etc., are accompanied by a reduction in the value of these parameters. In this case, the calculator therefore records only the negative deviations between the instantaneous value and the mean value. With regard to the temperature, on the other hand, it is an increase which signals the defect and, in this case, the calculator will only retain the positive deviations.

In all three cases, a comparison is made between the absolute value of this deviation and a reference deviation which has been determined beforehand and entered in the memory of the calculator.

Any deviation value lower than the reference deviation will be translated by the absence of a signal at the output of the calculator. On the other hand, any higher value will result in a signal for the reduction of the casting speed. This reduction can be made progressively or by stages of a determined duration and lasts until the deviation becomes lower than the reference deviation again. Throughout this phase, the mean value retained by the calculator is the one corresponding to the period of time $\Delta t$ immediately prior to that when the deviation became higher than the reference deviation.

This reference deviation is generally less than 10% of the mean value of the parameter under consideration so as to have a suitable response time.

The period of time $\Delta t$ is preferably less than 10 minutes so that the fluctuations in the parameter can be followed to an optimum.

If the reduction in speed is made by successive stages, the reduction corresponding to each stage is less than 15% of the value of the speed at the moment immediately beforehand. Each stage lasts less than 5 minutes.

After a greater or smaller reduction in speed, the deviation becomes lower than the reference deviation again. At this moment the calculator transmits a signal to increase the speed, of which the value is less than 10% of the speed value at the preceding moment and continues to compare the deviation between the instantaneous value of the parameter and the mean value of the parameter throughout a period of time immediately beforehand and lasting less than 5 minutes. This increase can also be made progressively or by successive stages. In this latter case, the increase in the speed at each stage is less than 10% of the speed value at a moment immediately beforehand, the duration of the stage being less than 5 minutes. The increase takes place for as long as the deviation in one of the three parameters does not exceed the reference deviation.

The casting machine will therefore always operate at the maximum speed compatible with the absence of defects.

It can be said that the method of the invention optimizes the conditions for obtaining a product of high quality because, simultaneously:

- it permits maximum productivity;
- it prevents all visible or invisible defects in solidification as it can operate continuously, and those resulting from stoppages of the machine;
- it reduces the labor needed for supervising the machine;

it causes the machine to operate under better conditions as it no longer stops;

it provides, via the calculator, a recording of the casting parameters which is a type of record card for the cast strip.

DETAILED DESCRIPTION OF THE INVENTION

The invention will be understood better with reference to the single FIGURE showing a type of machine and a supply nozzle 1 through which the liquid metal is admitted between the two rolls 2 and 2', of which the journals 3 and 4 are held by the chocks 5 and 6 integral with the column 7. After cooling and rolling, the metal leaves the casting process in the form of a strip 8 which is wound at 9.

The rolls are set into rotation in opposite directions by means of the motor 10.

The intensity which permits the torque to be evaluated is detected at 11 on the supply circuit of the motor.

On the hydraulic circuits 12 and 12' arranged in the columns at 7 and 7' there are placed two pressure gauges 13 and 13' permitting the effect of rolling to be evaluated while an optical pyrometer scans the width of the strip at 14 so as to determine the temperature thereof. These three measurements are transmitted to the calculator 15 which controls the speed of the motor at 16 by modifying the voltage of the supply current.

The application of the invention is illustrated by the following example:

A machine of the SCAL Jumbo 3C type as well as a PERKIN ELMER 1620 mini computer is used. The cast alloy is 1050, of which the composition is described in "Standard for Aluminum Mill Products", published by Aluminum Association. The thickness of the strip is 10 mm.

The torque is measured via the intensity of the motor driving the rolls of the machine (direct current motor).

The rolling stresses are measured via two pressure gauges measuring the pressure of the hydraulic circuit on each of the two columns.

The temperature of the strip on leaving the rolls is measured by an optical pyrometer which scans the entire surface of the strip.

The program for the reduction and increase in the speed by the calculator is as follows:

(a) the linear speed of the rolls is varied every two minutes by a value of 0.01 m/mn;

(b) the values of intensity of the hydraulic pressures and of the temperature are recorded by the calculator every second;

(c) the defects are detected in the following manner: the intensity of the roll drive motor as well as the values of the hydraulic pressures in the columns and the temperature of the strip are compared every second to the mean values calculated from the 120 measurements preceding the instant under consideration. If the deviations between the respectively calculated instantaneous values and mean values of the intensity of the pressure are negative and less in absolute value than a deviation corresponding to 2% of the mean values, the casting is judged to be stable and the procedure for increasing the speed described above is followed. Similarly, if the deviation between the temperature measured at this instant and the mean temperature is positive and does not exceed 5° C., the casting is judged to be stable. If at least one of the deviations in the intensity and the pressure is negative and exceeds in absolute value 2% of the mean value of the corresponding parameter and/or if the deviation in the temperature is positive and exceeds 5° C., the casting is judged to be unstable. In this case, the calculator immediately gives an order to decelerate the linear speed of the rolls by a value of 0.05 m/mn. If, after 10 seconds, all the deviations between the instantaneous values of the intensity of the motor of the rolls, the two pressures as well as the temperature of the strip and the mean values of these parameters have not become less than the reference deviations again, the calculator gives a second order to declerate the rolls by 0.05 m/mn. This procedure is repeated until each of the deviations is lower than the reference deviation. The casting operation is thus again judged to be stable and the calculator proceeds to increase the speed as described above.

The maximum instantaneous speed measured under these conditions is 1.25 m/mn, which corresponds to a productivity of approximately 2.02 tons per hour and per meter of width of strip produced. Beyond this, defects in solidification appear. On the other hand, the maintenance of continuous casting at this speed is very difficult and it demands perfect constancy of the temperature of the liquid metal in the casting runner, of the lubrication of the cylinders, etc. However, the process described above has permitted a mean speed of approximately 1.22 m/mn, that is to say a mean productivity of 1.98 tons per hour and per meter of width to be maintained in continuous operation, without any defect in the solidification of the strip.

The method according to the invention is applied in the continuous casting of metals between rolls whenever the conditions for obtaining a quality product and, in particular, for increasing productivity are to be optimized.

I claim:

1. A method for the monitoring and control of operating parameters of a machine for the continuous casting of strips between journalled rolls, in which consideration is given to at least one of the parameters from the group consisting of the torque exerted on at least one of the rolls to cause the strip to advance and the stress exerted by the strip on at least one of the journals, the deviation between the instantaneous value of the parameter under consideration and the mean value of the same parameter are measured over a period of time immediately beforehand; reducing the speed of casting when this deviation becomes negative and greater in absolute value than a reference deviation, until the deviation becomes less than the reference deviation; increasing the casting speed for as long as the deviation between the instantaneous value of the parameter and the mean value of this parameter over a period of time immediately beforehand does not exceed the reference deviation.

2. A method according to claim 1, in which the mean value of the parameter is established over the period of time immediately prior to that when the deviation becomes higher than the reference deviation.

3. A method according to claim 1, in which the reference deviation is less than 10% of the mean value of the parameter.

4. A method according to claim 1, in which the period of time immediately beforehand is less than 10 minutes.

5. A method according to claim 1, in which the speed is reduced by successive stages.

6. A method according to claim 1, in which the casting speed is reduced at each stage by a quantity of less than 15% of the speed value at the moment immediately beforehand.

7. A method according to claim 1, in which each stage in the reduction of the speed has a duration of less than 5 minutes.

8. A method according to claim 1, in which the speed is increased by successive stages.

9. A method according to claim 1, in which the speed of casting is increased at each stage by a quantity which is less than 10% of the speed value at a moment immediately beforehand.

10. A method according to claim 1, in which each stage in the increase in speed has a duration of less than 5 minutes.

11. A method according to claim 1 wherein consideration is additionally given to the parameter of the temperature of the strip upon leaving the rolls and the casting speed is reduced when the deviation of the parameter of temperature becomes positive.

* * * * *